United States Patent [19]

Kanazawa et al.

[11] Patent Number: 4,727,734

[45] Date of Patent: Mar. 1, 1988

[54] ULTRASONIC WASHING MACHINE

[75] Inventors: Masao Kanazawa, 6-10, Nakakagaya 4-chome, Suminoe-ku, Osaka; Yukio Ooka, Toyonaka, both of Japan

[73] Assignee: Masao Kanazawa, Osaka, Japan

[21] Appl. No.: 780,081

[22] Filed: Sep. 25, 1985

[51] Int. Cl.[4] ..... B08B 3/12

[52] U.S. Cl. ..... 68/355; 366/127

[58] Field of Search ..... 134/1, 25.2, 30, 37, 134/184; 68/355; 366/113, 127

[56] References Cited

U.S. PATENT DOCUMENTS

| | | | |
|---|---|---|---|
| 2,417,722 | 3/1947 | Wolff | 366/127 X |
| 2,468,550 | 4/1949 | Fruth | 68/355 X |
| 2,666,440 | 1/1954 | Collins | 134/182 X |
| 2,828,231 | 3/1958 | Henery | 134/1 |
| 3,033,710 | 5/1962 | Hightower et al. | 134/1 |
| 3,098,370 | 7/1963 | Poole et al. | 68/355 |

FOREIGN PATENT DOCUMENTS

| | | | |
|---|---|---|---|
| 844087 | 3/1952 | Fed. Rep. of Germany | 68/355 |
| 2,907,562 | 8/1980 | Fed. Rep. of Germany | 68/355 |

*Primary Examiner*—Timothy F. Simone
*Assistant Examiner*—Frankie L. Stinson
*Attorney, Agent, or Firm*—Wenderoth, Lind & Ponack

[57] ABSTRACT

An ultrasonic washing machine as an air bubble supplying device and an ultrasonic generator. The ultrasonic generator works with textile products such as fabrics, yarns, ropes, etc. placed in a tub filled with water. Air bubbles produced by the cavitation effect of the ultrasound cling to the surface of the textile products and help remove stains, alien matter, etc. adhering to them. Part of the air, fed from the outside by an air bubble supplying device, constantly dissolves in the water, whereby the air consumed by the cavitation is supplemented; the rest of the air, not dissolved in the water, diffuses the ultrasound when ascending in the water as bubbles, which serves to greatly improve the washing effect.

9 Claims, 4 Drawing Figures

ULTRASONIC WASHING MACHINE

BACKGROUND OF THE INVENTION

1. Field of the Invention:

This invention relates to an ultrasonic washing machine used to wash textile products such as fabrics and yarns; it is equipped with an ultrasonic generator and an air bubble supplying device.

2. Description of the Related art:

A conventional washing machine for textile products generally has a stirrer to agitate them in a detergent solution; therefore, a considerably large and powerful motor is required to move the stirrer. Moreover, washed textile products tend to be wrinkled, twisted or injured. Also, as a matter of course, the damage caused by a detergent cannot be looked over. Apart from the above, another type washing machine has been used in textile finishing plants to wash away stains such as oils or sizing materials given to fabrics or yarns prior to a dyeing process. A washing machine of this type has a structure as shown in FIG. 4. That is, a rotary drum with many holes on the side is installed in a tub 110; the rotary drum being supported horizontally by an eccentrically fixed shaft 113 so as to cause a swinging movement at a constant rate. A tension roller 114 is arranged above the tub 110 and is charged with a detergent solution. A washed long fabric 120, for example, is guided and sent out of the tub by the tension roller 114 continuously after having made a round-trip on the drum 111. With the fabric being wound on the perforated rotary drum 111, the detergent solution is able to pass through the fabric mesh to and fro each time the drum rotates with a swinging cyclic motion by the action of the eccentrically fixed shaft. On account of this, stains on the fabric are washed away by an oscillational impact of the detergent solution against the fabric. However, a washing machine of this type submits both the rotary drum and textile products to such significant vibrations that the rotary drum needs to have a large and strong construction; consequently, the fabric tends to be damaged.

SUMMARY OF THE INVENTION

Under the circumstances, it is an object of this invention to provide a miniaturized ultrasonic washing machine that is, energy-conserving, requires no detergent and is suitable for washing textile products. It is another object of this invention to provide an ultrasonic washing machine capable of washing textile products such as fabrics, yarns, ropes and the like without damaging them.

The above and further objects and novel features of the invention will more fully appear from the following detailed description when the same is read in connection with the accompanying drawing. It is to be expressly understood, however, that the drawings are for purpose of illustration only and are not intended as a definition of the limits of the invention.

DESCRIPTION OF THE PREFERRED EMBODIMENTS

Figure 1:
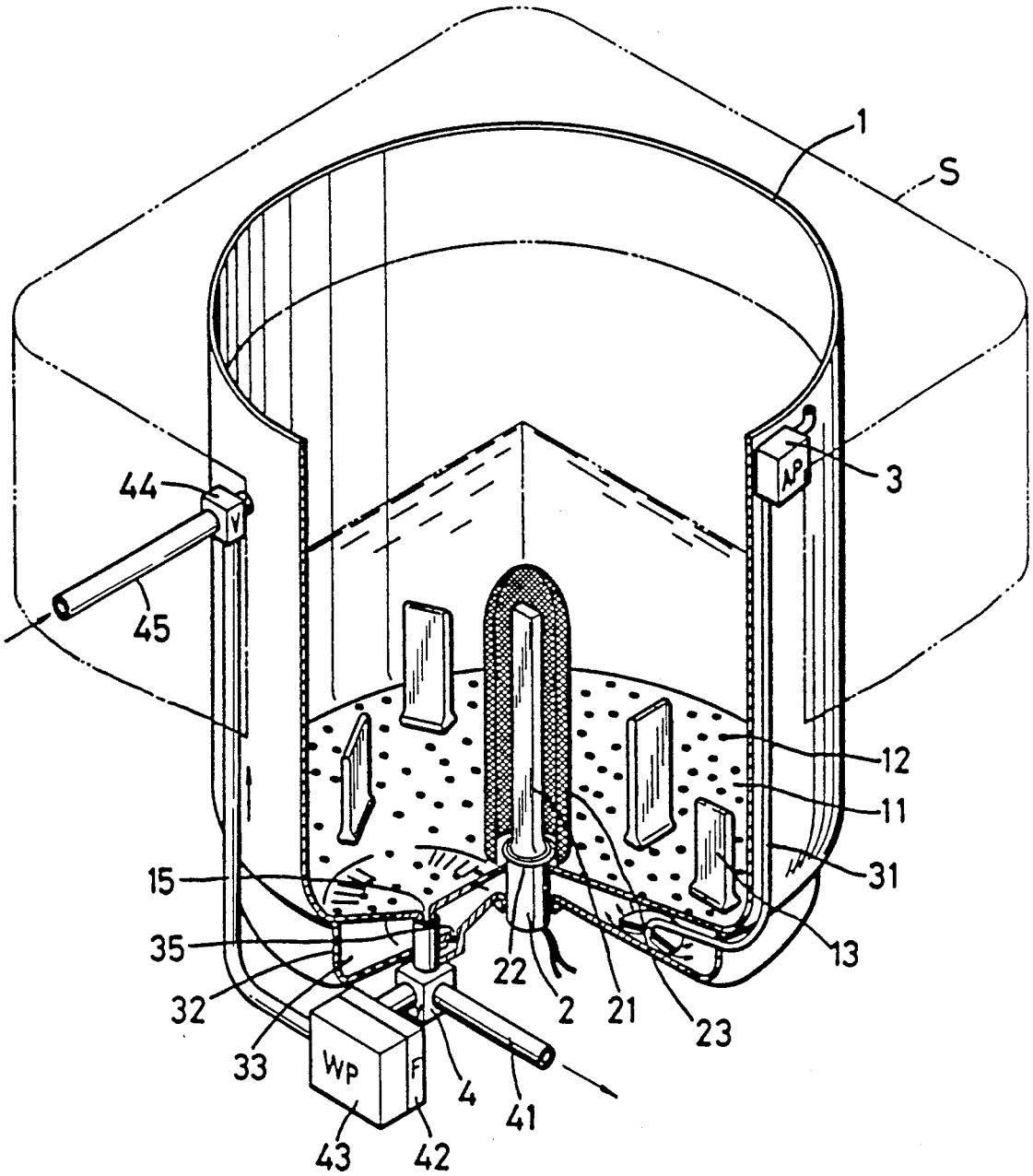
FIG. 1 is a partially cutaway perspective view of a washing machine of the present invention.

The washing machine shown in FIG. 1 as the first embodiment of this invention is used to wash textile products. In the figure, the numeral 1 designates a cylindrical metal tub with a top end that is opened. Lots of small holes 12 are pierced in its bottom 11. Also, a plurality of metal plates 13 stand upright on the bottom 11 with their sides oriented randomly in every direction.

At the center of the bottom is an ultrasonic generator 2 having an oscillator 21 projecting from bottom of the tub; a joint of the oscillator is sealed water-tight near the bottom. A metal basket 23 having a comparatively large mesh portion covers the oscillator 21. The frequency of the ultrasonic generator is variable optionally in the range 10–60 KHz by means of a dial type selector (not shown here) for example to vary the frequency based on the type of textile products to be washed. That is, the frequency is made higher, in the scope of the range, in order for rayon, cotton, linen, silk, wool and nylon as long as textile materials are concerned. Additionally, the frequency has to be adjusted to the weave of the fabrics. In view of this, it is natural that the ultrasonic generator is designed in such a way that the frequency can be changed to an optimum degree in the above range.

The oscillator is desirable to have no directivity in order that generated ultrasound may propagate uniformly all over the tub. In the case that an oscillator has directivity, it is recommendable that a plurality of oscillators are placed in the tub so as to send ultrasound in every direction or a plurality of reflectors are placed in the tub so as to diffuse and reflect the ultrasound.

The washing tub is made of metal in order to reflect ultrasound effectively. But it may be coated with a synthetic polymer that is so thin that it does not hinder the ultrasonic reflection.

A bubble supplying room 33 is formed between the perforated bottom 11 and a base plate 32. An air pump 3 for feeding air into the bubble supplying room through a pipe 31 is attached to the upper part of the outside of the tub. Air may be fed into the tub through a porous material or through lots of small holes pierced in the base plate. A water outlet 15 on the bottom 11 and a water outlet 35 on the base plate 32 similarly lead to a switch valve 4, where part of the spent water is exhausted through a pipe 41 while the rest is allowd to pass through a filter 42 and reach a pump 43 which communicates with a water inlet valve 44. A pipe 45 through which fresh water is supplied is also connected to the valve 44. Since part of spent water circulates for re-use through the outlet, the valve 4 and the inlet, the consumption of water can be reduced greatly.

When a plurality of projecting metal plates are provided on the bottom of the tub with their sides randomly oriented in every direction, generated ultrasound is diffused and reflects on them to prevail all over the tub uniformly, which makes water penetrate into the fabric. Thus, more effective washing can be expected.

Working steps in the first example of a washing machine of this invention will be described in detail with referrence to the accompanying drawing as follows: To begin with some water in proportion to the quantity of clothes is put in the tub 1 through a water inlet pipe 45. At this moment, the valve 4 is closed to the pump 43.

Next, and desirably, clothes composed of the same sort of fabric are put in the tub 1. They soon sink in the water, but do not assemble because there are projecting metal plates 13 standing on the bottom. The clothes absorb enough water and leave very little air on themselves. Stirring clothes with hands helps get air away from them.

A dial type frequency selector on the ultrasonic generator 2 is set to a proper frequency for washing the fabric and the ultrasonic generator is switched on. At this time, the oscillator 21 generates ultrasound, part of which passes through the mesh of the basket 23 or is diffused by reflection upon impinging on the mesh and then reaches the fabric. Another part of the generated untrasound reflects upon impinging on the projecting metal plates 13 and the inside of the tub 1 and then reaches the fabric. Thus, effective washing can be made by the formation of such an ultrasonic network.

Specifically speaking, when clothes absorb so much water so as not to leave air on them, part of the ultrasound directly gets to clothes. The sonic impedance of clothes ($2.9\times10^5$ cm g sec) being nearly equal to the sonic impedance of water ($1.5\times10^5$ cm g sec), and the reflectance and the absorptance of the ultrasound being about 0.097 and 0.903 respectively that means about 90 percent of the ultrasonic energy is absorbed by the clothes. Nonetheless, the mesh of a fabric being comparatively coarse, the ultrasound can pass through a few sheets of fabrics by the cavitation effect, which helps stains release from fabrics.

During or after the generation of the ultrasound, the air pump 3 is caused to work to send surrounding air to the bubble supplying room 33 by way of the pipe 31. The air, fed into the room, ascends in the water from lots of holes pierced in the bottom as small bubbles. Some air bubbles dissolve in the water but the rest goes up to the water surface, remaining in the form of bubbles. Hence, these air bubbles give the ultrasound more chance to be diffused by reflecting on them and help it prevail all over the tub uniformly. The reflection on the air bubbles is due to a large difference in the sonic impedance between water and air. The ultrasound, not directly getting to the fabric but to the inside wall of the tub, eventually strikes the fabric after being reflected.

In this way, the ultrasound hitting the fabric gives rise to bubbles on the fabric surface by the cavitation effect, which makes stains or alien matters liberate from the fabric. As long as the cavitation continues, the formation of air bubbles could become lessened with the passage of time because air dissolving in the water is used up. However, as mentioned above, part of the air, fed from the bubble supplying room 33, dissolves in the water from time to time, so that air bubbles are constantly formed and never disappear. Therefore, stains or alien matters are completely removed.

After washing, the ultrasonic generator 2 and the air pump 3 are switched off to stop. Spent water in the tub 1 and the bubble supplying room 33 is exhausted from the pipe 41 when the valve 4 is switched to the pipe. If the next washing has to be made without exhausting spent water, then the valve 4 is switched to the pump 43 and the pump 43 is caused to work. Spent water is filtered by the filter 42 and fed back into the tub 1 by way of the valve 44. The filter 42 being replaceable, spent water can be used again and again. Therefore, a considerable amount of water can be saved economically.

Figure 2:
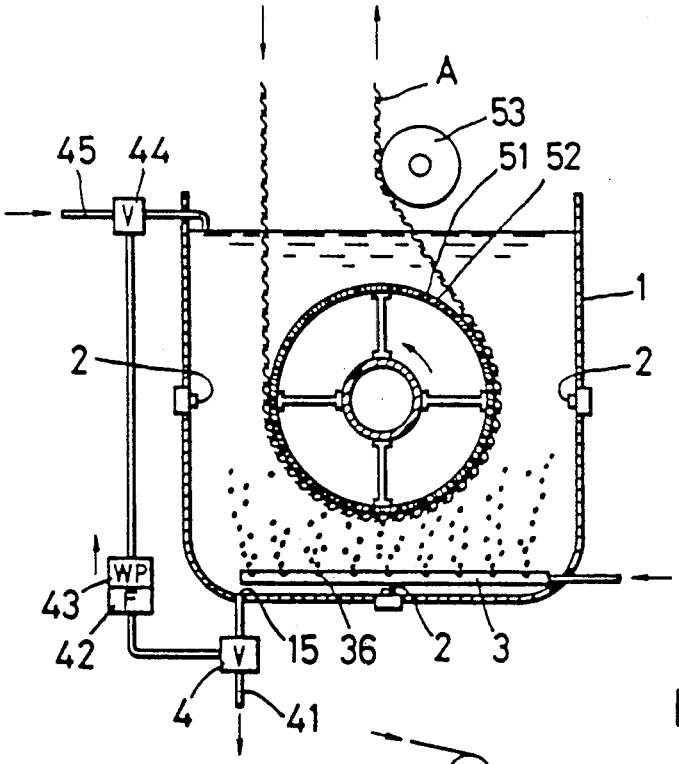
FIG. 2 is a longitudinal cross-sectional view showing a second embodiment of the present invention.
Figure 3:
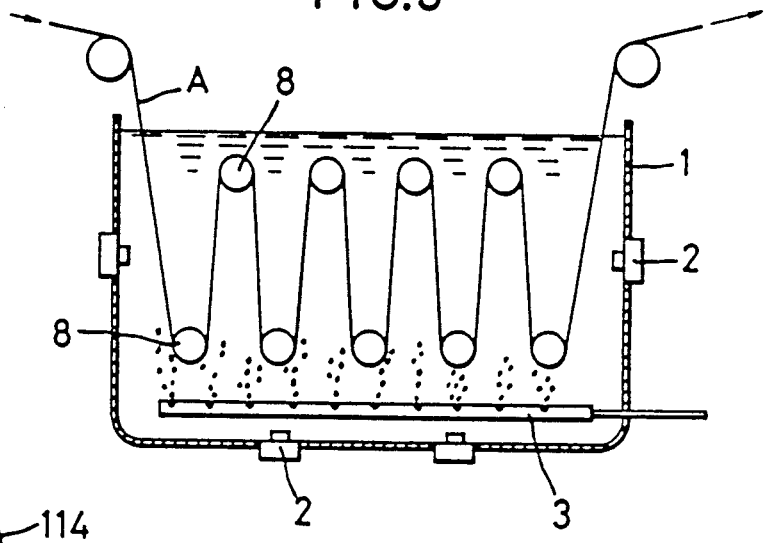
FIG. 3 is a longitudinal cross-sectional view showing a variation of the second embodiment.
Figure 4:
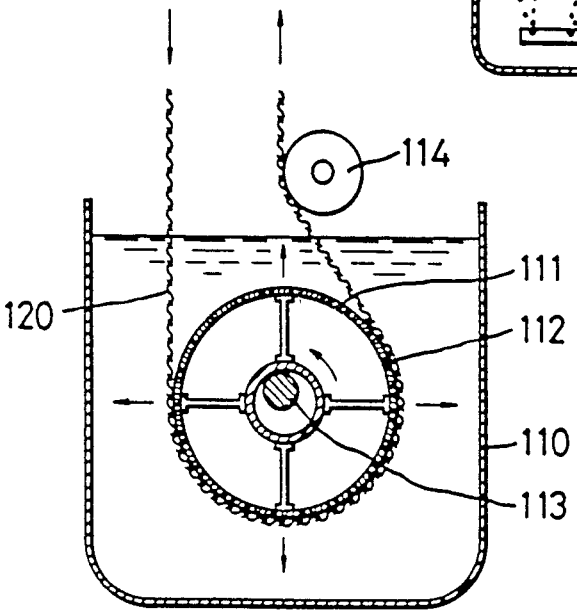
FIG. 4 is a longitudinal cross-sectional view of a conventional washing machine.

Similar to the first embodiment, the second embodiment and a variation thereof will be explained with referrence to FIGS. 2 and 3, in which the same elements and elements whose action is practically the same as those in the first embodiment are designated by the same numeral used in FIG. 1. In FIG. 2, a rotary drum 52 having many holes 51 on the circumference thereof is supported horizontally almost in the center of a tub 1. A long fabric or a bundle of yarn A is wound on the perforated rotary drum and is given a certain tension by a tension roller 53; therefore, textile products A are able to pass through the tub at a constant speed.

The tub is at first charged with so much water as to at least submerge the drum. At this moment, a valve 4 is closed to a pump 43. Next, a frequency selector of an ultrasonic generator 2 is set to a degree proper for washing the textile products and the ultrasonic generator is switched on. Ultrasound is generated, a part of which directly reaches the textile products and the other of which is reflected by hitting the inside of the tub 1 before reaching the textile products.

During or after the generation of the ultrasound, an air pump (not shown here) is caused to work and send air to a bubble supplying device 3. The air, fed into the room, ascends in the water from lots of holes 36 provided on the bubble supplying device as small bubbles. Some air bubbles enter the inside of the rotary drum 52 through the openings on both sides. Some air bubbles dissolve in the water as they ascend in the water, but the rest goes up to the water surface bubble form. Accordingly, the air bubbles help the ultrasound be diffused and reflected so as to more frequenctly prevail over the tub 1 uniformly. Some air bubbles hit the inside of the tub, are reflected thereby and enter the rotary drum through the openings on both sides; some enter the rotary drum through the holes 51 and mesh of the textile products such as fabrics and yarns, and hit the backside of the products that are kept in contact with the rotary drum. Since some air bubbles constantly dissolve in water, air in water is not exhausted by the cavitation; on the contrary, air bubbles are produced from time to time, which causes stains or alien matters to get away from the textile products with ease.

Meanwhile, a variation of the second embodiment is in essence the same as the second embodiment in concept. However, in this variation,, rollers 8 having small diameters are arranged to zigzag in a long tub in order for textile products to be able to undergo washing for a longer time, as shown in FIG. 3. The structure is such that generated ultrasound is able to hit their both sides equally. In addition, they are spread so fully that the rollers need not to be perforated like the rotary drum of the second example. Therefore, washing can be carried out very effectively.

We claim:

1. An ultrasonic washing machine for washing articles, said machine comprising:

a metal tub having a bottom and an open upper end through which the articles to be washed are placed in said tub, and fluid inlet means through which water is supplied to said tub;

an ultrasonic generator fixed to and within said tub for generating ultrasound in the water supplied to said tub through said fluid inlet means; and bubble supplying means at the bottom of said tub for supplying and dispersing air bubbles throughout the water supplied to said tub some of which dissolve in the water to replace air that has been removed from the water due to cavitation when said ultrasonic generator generates ultrasound and the remainder of which reflects the ultrasound to diffuse the ultrasound throughout said tub onto the articles to be washed in said tub.

2. An ultrasonic washing machine as claimed in claim 1, wherein said ultrasonic generator generates ultrasound having an ultrasonic frequency between 10 KHz and 60 KHz.

3. An ultrasonic washing maching as claimed in claim 1, wherein said ultrasonic generator is variable to generate ultrasound having a range of ultrasonic frequencies between 10 KHz and 60 KHz.

4. An ultrasonic washing machine as claimed in claim 1, wherein said tub further comprises a water outlet through which the water supplied to the tub by said water inlet means is drained; and further comprising a filter and a pump operatively connected between said water inlet means and said water outlet, said filter for filtering a portion of the water drained from said tub through said water outlet and said pump for pumping said portion to said water inlet means for recirculation thereof.

5. An ultrasonic washing machine as claimed in claim 1, and further comprising a plurality of metal plates projecting from the bottom of said tub and having sides randomly oriented relative to one another for reflecting the ultrasound generated by said ultrasonic generator to diffuse the ultrasound throughout said tub onto the articles to be washed in said tub.

6. An ultrasonic washing machine as claimed in claim 1, and further comprising a driven roller rotatably mounted within said tub and around which the articles to be washed are wrapped for moving the articles through the water supplied to said tub.

7. An ultrasonic washing machine as claimed in claim 6, wherein said roller is a rotary drum having a plurality of holes extending therethrough.

8. An ultrasonic washing machine as claimed in claim 1, wherein said ultrasonic generator is disposed on the bottom of said tub.

9. An ultrasonic washing machine as claimed in claim 1, wherein said ultrasonic generator comprises a rod-like oscillator extending within said tub in a longitudinal direction, and the bottom of said tub comprises a perforated metal plate; and said bubble supplying means comprises a chamber disposed below the bottom of said tub, an air supply means for supplying air into said chamber, and said perforated metal plate through which the air passes to form said bubbles.

* * * * *